US007014310B2

(12) United States Patent
Hirai

(10) Patent No.: US 7,014,310 B2
(45) Date of Patent: Mar. 21, 2006

(54) INKJET IMAGE FORMING METHOD AND INKJET IMAGE FORMING SYSTEM

(75) Inventor: Yoko Hirai, Hachioji (JP)

(73) Assignee: Konica Corporation, (JP)

( * ) Notice: Subject to any disclaimer, the term of this patent is extended or adjusted under 35 U.S.C. 154(b) by 17 days.

(21) Appl. No.: 10/393,574

(22) Filed: Mar. 20, 2003

(65) Prior Publication Data

US 2003/0202079 A1 Oct. 30, 2003

(30) Foreign Application Priority Data

Mar. 28, 2002 (JP) ..... 2002-091184

(51) Int. Cl.
*B41J 2/01* (2006.01)

(52) U.S. Cl. ..... 347/102; 347/101; 347/100

(58) Field of Classification Search ..... 347/102, 347/101, 100, 96, 95, 105; 106/31.13, 31.27, 106/31.6; 523/160
See application file for complete search history.

(56) References Cited

U.S. PATENT DOCUMENTS

| | | | | |
|---|---|---|---|---|
| 5,721,020 | A * | 2/1998 | Takami et al. | 427/508 |
| 5,889,084 | A * | 3/1999 | Roth | 523/161 |
| 5,977,207 | A * | 11/1999 | Yui et al. | 523/160 |
| 6,145,979 | A * | 11/2000 | Caiger et al. | 347/102 |
| 6,232,361 | B1 * | 5/2001 | Laksin et al. | 523/160 |
| 6,280,801 | B1 * | 8/2001 | Schmitt | 427/511 |
| 6,558,753 | B1 * | 5/2003 | Ylitalo et al. | 427/466 |
| 2003/0112307 | A1 * | 6/2003 | Maeda et al. | 347/102 |

* cited by examiner

*Primary Examiner*—Manish S. Shah
(74) *Attorney, Agent, or Firm*—Squire, Sanders & Dempsey L.L.P.

(57) ABSTRACT

The present invention relates to an inkjet image forming method including: jetting an ink hardenable by an irridation of an active ray from an inkjet head on a recording material while conveying the recording material; and irridating the active ray on the jetted recording material, wherein a total of the input electric power of a light source of the active ray of light is 0.05–20 W/cm, and the inkjet head have plural nozzles arrayed in a direction perpendicular to a direction, which the recording material is conveyed.

6 Claims, 2 Drawing Sheets

INKJET IMAGE FORMING METHOD AND INKJET IMAGE FORMING SYSTEM

TECHNICAL FIELD

The present invention relates to an inkjet image forming method, and particularly, to an inkjet image forming method using an ink which can be hardened by an irradiation of an active ray and to an ink jet image forming system.

BACKGROUND

An inkjet image forming method utilizing ink, which can be hardened by an irradiation of an active ray, is remarked as an method to solve the problems of the conventional inkjet from the reasons like that it is not necessary to select the recording material, it is superior in the light resistibility, and it is superior in the working safety because the solvent is not included. Particularly, because drying is not necessary and the hardening time is short, the compatibility with the printer which is printing at a high speed such as a line printer, is high. In order to obtain a high quality image in the inkjet method utilizing above specified ink, it is necessary that the irradiation method is optimized, however, up to now, although, as described in Japanese Unexamined Patent Publication (JP-A) No. S60-132767 or WO 9954415, the basic method for the hardening is disclosed, none of proposals for increasing the quality of the printing, such as the banding, color contamination, resolution, adhesive property, or recording material contraction, is made.

That is, an inkjet image forming method, apparatus and ink which are superior in the banding, cross color and gradation property, and is high quality are strongly desired.

SUMMARY

The above-described problems can be solved in accordance with the present invention.

One embodiment of the invention is an inkjet image forming method comprising: jetting ink, which is hardenable by an irradiation of an active ray, from an inkjet head onto a recording material while conveying the recording material; and irradiating the active ray on the jetted recording material, wherein a total of input electric power of a light source of the active ray is 0.05–20 W/cm. The inkjet head may have plural nozzles arrayed in a direction perpendicular to the direction, which the recording material is conveyed. Further, the inkjet head may be arranged as approximately fixed over the direction perpendicular to the direction, which the recording material is conveyed.

Another embodiment of the invention is an inkjet image forming method comprising: jetting ink, which is hardenable by an irradiation of an active ray, from an inkjet head on a recording material while conveying the recording material; and irradiating the active ray on the jetted recording material, wherein the number of printing colors are not smaller than 2, and after the n-th color ink is jetted, (n+1)-th color ink is jetted after the active ray is irradiated over the width direction. The inkjet head may have plural nozzles arrayed in a direction perpendicular to the direction, which the recording material is conveyed. Further, the inkjet head may be arranged as approximately fixed over the direction perpendicular to the direction, which the recording material is conveyed. The input electric power of the light source used for the irradiation of the active ray conducted between the jetting of the n-th color and the (n+1)-th color may be 0.05–20 W/cm.

DETAILED DESCRIPTION

Figure 1:
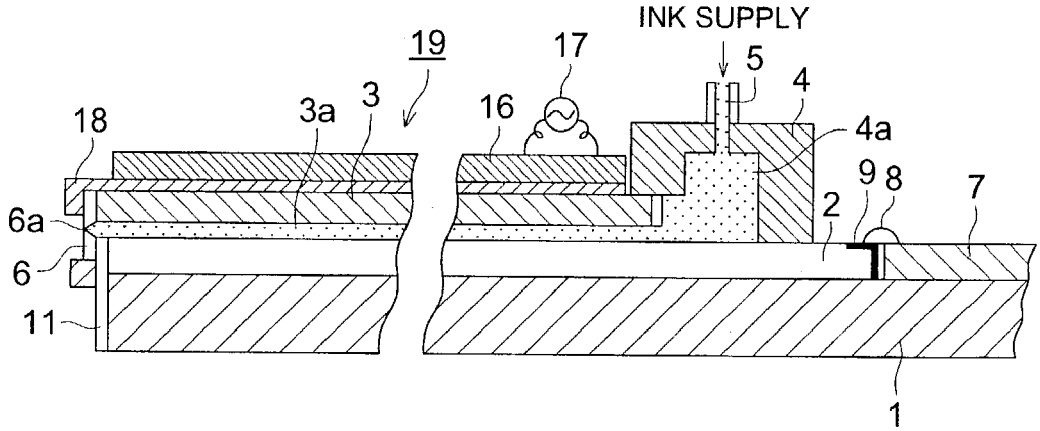
FIG. 1 is a structural sectional view of the inkjet head, which is an example of the inkjet printer using the ink hardenable by an irradiation of an active ray, used in the present invention.

The present invention will be detailed below.

For the ink jet printer, any publicly known ink jet printer or parts or device thereon to assemble the printer can be used in the invention. The printer of the present invention is to have at least one ink jetting section and at least one an active ray irradiating section.

(Ink Jet Head)

A publicly known inkjet head can be used for the inkjet head used in the present invention. A continuous type or dot on demand type inkjet head can be used. In a thermal head in the dot on demand type, a type, which has an operating valve for jetting as described in JP-A No. H9-323420, is preferable. In a piezoelectric head, a head as disclosed in, for example, EP-A-0277703, EP-A-0278590, U.S. Pat. Nos. 4,879,568, 4,887,100 or 5,028,936 can be used. In the inkjet head, it is preferable that the head has a temperature control function so that the temperature of the ink can be controlled. It is preferable that a jetting temperature is set so that the viscosity at the jetting is 5–25 mPa·s, and the ink temperature is controlled so that the variation width of the viscosity is within ±5%. It is operated at the drive frequency of 5–500 kHz.

The inkjet head used in the present invention may have plural nozzles arrayed in the direction perpendicular to the direction, which the recording material is conveyed. A nozzle pitch (the distance between each nozzles) set so as not to be broader than the resolution of the direction perpendicular to the recoding material-conveyed direction is preferable. In case, nozzle head having the nozzle pitch of not broader than the resolution is not obtained in one head, plural inkjet heads can be combined to obtain the desired construction of the present invention. In the same manner, in case where the printing width is wide, plural heads can be arranged in the width direction to obtain the desired construction.

It is preferable to arrange the inkjet head approximately fixed in the width direction. The "approximately fixed" means the ink jet head having plural nozzles is arranged in the width direction, which is perpendicular to the recording material-conveyed direction, so that necessary nozzle number to obtain desired resolution can cover at least same length of width direction of the recording material without moving the ink head during printing. The one example of approximately fixed inkjet head is disclosed by JP-A H7-276619. By this configuration, the high speed and extremely excellent high-density color printing can be attained. The inkjet head "approximately fixed in the width direction" may include means for moving the head up and down for correcting the distance between the recording material and the nozzle surface. Further, a method for the printing while the head is finely oscillating as shown in JP-A No. 2001-301147 may be also included in the present invention. Plural ink jet heads can be combined to cover the width direction of the recording material.

(Light Source)

As the light source used in the present invention, a publicly known light source can be used. As a preferable light source, a near infra red ray, visible light ray, ultra violet ray, or a light source which emits electron beam, and particularly preferable one is a light source having the light emitting wavelength in the ultra violet area, and more preferable one is a light source whose main wavelength exists in 300–400 nm. For example, there is listed a low pressure mercury lamp, high pressure mercury lamp, metal halide lamp, excimer lamp, xenon lamp, halogen lamp, fluorescent lamp, cool cathode tube, no-electrode UV lamp, laser, or LED.

As a preferable irradiation method in the present invention, a method is preferable in which the rod-like light source is laid in the print width direction, and by which the active ray is irradiated at a predetermined timing after the arrival of the ink on the recording material.

It is preferable that the time from the arrival of the ink on the recording material to the irradiation of the light source is 0.0005–1 sec. By controlling the time for irradiation, the distance between the nozzle and light source may be appropriate to avoid the head contamination by the sublimation material generated by the hardening, or the nozzle choking by the light reflection. Further becoming larger fluctuation in the shape of dot depending on the recording material can be prohibited and the stable image quality can be obtained.

In case of the irradiation method in which there is the slope of the illuminance in the irradiation portion, the time from the arrival of ink to the irradiation is measured by making the time point at which the illuminance more than 1/10 of the maximum illuminance is obtained, as the irradiation start time.

The distance between light source and a upper surface of the recording material can be arranged within 0.5 mm to 300 mm, preferably 0.5 mm to 150 mm, more preferably 0.5 mm to 50 mm. By arranging the distance within those ranges, the source would not contact the recording material, and occurrence of jam or image stain due to the contact can be protected. Moreover, there is less influence such as distortion of recording material due to the heat from the source. Still, by controlling the distance in such range, the apparatus can be downsized and the parts to maintain the amount of light to the recording material are not necessary.

The total of the input electric power means that total of the input electric power of light source arranged after ink jetting section. For example, in FIG. 2 of printers, if the light source 20 is composed of two fluorescent lamps, the total of the input electric power is the sum of input electric power of the two fluorescent lamps. Like printers B or C, if there are plural ink jetting sections 19, the total of the input electric power is that of one light source 20, not sum of all the light sources 20.

In this invention input electric power of a light source is defined as the Watt/the length (cm) of a light source in the width direction crossing the recording material feeding direction.

Figure 2:
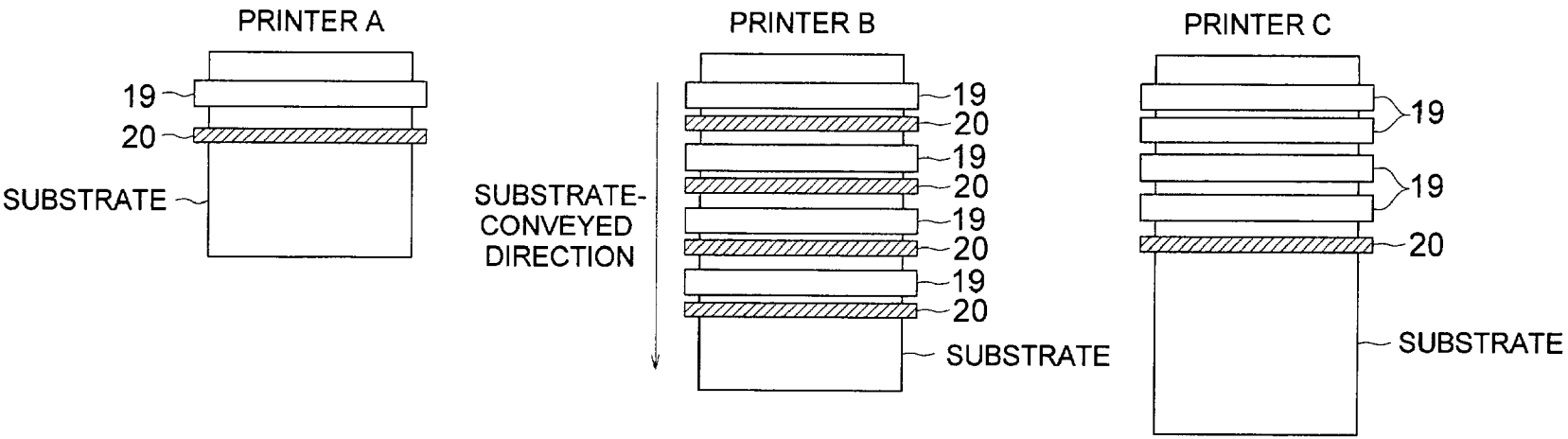
FIG. 2 is an outline structural view of the inkjet printer in which the inkjet head and the irradiation light source of the active ray are arranged.

In case there are plural color inks to be jetted, one light source may be installed at one position which is downstream to the last part of ink jetting section like printer C in FIG. 2. It is also acceptable to install the source of light at each position downstream to each ink jetting section like printer B in FIG. 2. In this invention, it is preferable to arrange the input electric power of a light source arranged in the irradiation width direction of the active ray of light to be 0.05–20 W/cm, in which the source is installed at between n-th color ink jetting section and n+1-th color ink jetting section. Preferably all of each light sources installed downstream to each ink jetting section have the input electric power of a light source arranged in the irradiation width direction of the active ray of 0.05–20 W/cm.

According to the present invention, it is possible to simplify the structure of an ink jet apparatus such as the apparatus without ventilation device, heater or cooler to keep the temperature around the irradiation section constant. Thus the apparatus which is less expensive and which can be maintained easily in the regards such as low electric power, long life of light source or apparatus itself can be obtained.

Furthermore, using the light source having electric power of 0.05–20 W/cm can make it possible to protect from occurrence of ozone which may make image quality worse, the recording material and/or the apparatus durability.

(Recording Material)

There is no particular limitation for the recording material used in the present invention. As a preferable recording material, a so-called no-absorptive material having no ink absorbing ability can be used. The no-absorptive material does not absorb ink by a fabric material such as paper, and does not have a resin layer, which absorbs the ink and is swollen, or a porous layer, which is provided by utilizing a filler and resin particles, on a film as an ink absorptive layer. As a specifically preferable recording material, a paper on whose surface the resin is coated, plastic film, plastic sheet, metal, ceramic, or glass, is listed.

(Ink)

The publicly known active ray-hardening composition can be used as the ink hardenable by the irradiation of the active ray in the present invention. For example, the mixture of the photo-radical generator and radical polymeric compound, or the mixture of the photo-cation initiator and cation polymeric compound is used. Specifically, the ink described in JP-A Nos. H3-243671, 2000-38531, H2-311569, H3-216379, or WO 99/29787, can be used. Ink including at least oxetane compound, epoxy compound, or vinyl ether compound, and having the following composition, is preferable in them. The oxetane compound, epoxy compound, or vinyl ether compound, each can be added into the ink in separately or by being mixed up. If all of them are mixed together, preferable mixing rate is oxetane compound/epoxy compound/vinyl ether compound of 50–90 wt %/10–50 wt %/0–40 wt %.

(Oxetane Compound)

Initially, the oxetane compounds, which can be used in the present invention, will be described, however, the present invention is not limited to those. The oxetane compound preferably used in the present invention is a compound having the oxetane ring, and all publicly known oxetane compounds as described in JP-A No. 2001-220526, or JP-A No. 2001-310937, can be used. This invention does not preclude from using plural oxetane compounds in the same time.

In the compound having the oxetane ring used in the present invention, the compound having 1–4 oxetane rings is preferable. When the compound having the oxetane rings of 1 to 4 is used, because the viscosity of the composition can be kept appropriately, the handling becomes not difficult, or the glass transition temperature of the composition can be also maintained properly to use, the coking property of the hardened material becomes sufficient.

As the compound having one oxetane ring, the compound shown by the following General formula (1) is listed.

General formula (1)

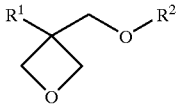

In the formula, $R^1$ is a hydrogen atom, alkyl group having 1–6 carbon atoms such methyl group, ethyl group, propyl group or butyl group, fluoro-alkyl group having 1 to 6 carbon atoms, allyl group, aryl group, furyl group, or thienyl group. $R^2$ is an alkyl group having 1 to 6 carbon atoms such as methyl group, ethyl group, propyl group or butyl group; alkenyl group having 2 to 6 carbon atoms such as 1-propenyl group, 2-propenyl group, 2-methyl-1-propenyl group, 2-methyl-2-propenyl group, 1-butenyl group, 2-butenyl group or 3-butenyl group; a group having aromatic ring such as phenyl group, benzyl group, fluoro-benzyl group, methoxybenzyl group or phenoxy-ethyl group; alkyl carbonyl group having 2 to 6 carbon atoms such as ethyl carbonyl group, propyl carbonyl group or butyl carbonyl group; alkoxy carbonyl group having 2 to 6 carbon atoms such as ethoxy carbonyl group, propoxy carbonyl group or butoxy carbonyl group; N-alkyl carbamoyl group having 2 to 6 carbon atoms such as ethyl carbamoyl group, propyl carbamoyl group, butyl carbamoyl group or pentyl carbamoyl group. As the oxetane compound used in the present invention, it is particularly preferable that the compound having one oxetane ring is used, because the obtained composition is excellent in the coking property, and the operability is excellent in the low viscosity.

Next, as the compound having two oxetane rings, the compounds shown by the following General formula (2) are listed.

General formula (2)

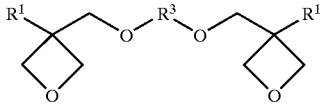

In the formula, $R^1$ is the same group as the group shown in the above-described General formula (1). $R^3$ is, for example, a linear or branching alkylene group such as ethylene group, propylene group or butylene group; linear or branching poly (alkylene-oxy) group such as poly (ethylene oxy) group or poly (propylene oxy) group; linear or branching un-saturated hydrocarbon group such as propenylene group, methyl propenylene group or butenylene group; carbonyl group; alkylene group including carbonyl group; alkylene group including carboxyl group; alkylene group including carbamoyl group. Further, $R^3$ may also be a polyhydric group selected from the group shown by the following General formulas (3), (4) and (5).

General formula (3)

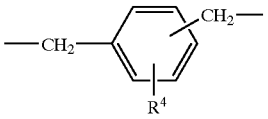

In the formulas, $R^4$ is a hydrogen atom, an alkyl group having 1 to 4 carbon atoms such as methyl group, ethyl group, propyl group or butyl group, or alkoxy group having 1 to 4 carbon atoms such as methoxy group, ethoxy group, propoxy group or butoxy group, or halogen atom such as chloride atom or bromine atom, nitro group, cyano group, mercapto group, lower alkyl carboxyl group such as the group having 1 to 5 carbon atoms, carboxyl group, or carbamoyl group.

General formula (4)

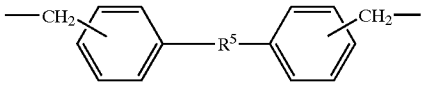

In the formula, $R^5$ is oxygen atom, sulfide atom, methylene group, NH, SO, $SO_2$, $C(CF_3)_2$, or $C(CH_3)_2$.

General formula (5)

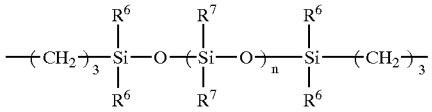

In the formula, $R^6$ is an alkyl group having 1 to 4 carbon atoms such as methyl group, ethyl group, propyl group or butyl group, or aryl group. Numeral n is an integer of 0–2000. $R^7$ is an alkyl group having 1 to 4 carbon atoms such as methyl group, ethyl group, propyl group or butyl group, or aryl group. $R^7$ is also a group selected from the group shown by the following General formula (6).

General formula (6)

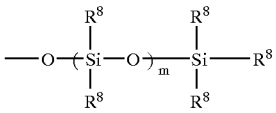

In the formula, $R^8$ is an alkyl group having 1 to 4 carbon atoms such as methyl group, ethyl group, propyl group or butyl group, or aryl group. Numeral m is an integer of 0–100. As a specific example of the compound having 2 oxetane rings, the compounds shown by the following structural formulas are listed.

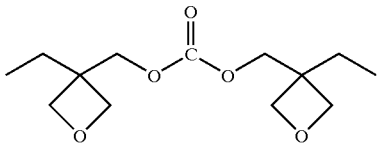

The compound shown by the above structural formula is, in the General formula (2), the compound in which $R^1$ is ethyl group, and $R^3$ is carboxyl group.

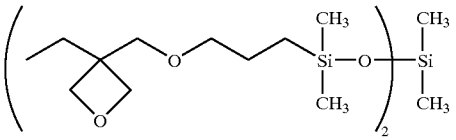

The compound shown by the above structural formula is, in the general formula (2), the compound in which $R^1$ is ethyl group, and $R^3$ is the general formula (5), $R^6$ and $R^7$ is methyl group and n is 1.

In the compound having 2 oxetane rings, as a preferable example except for the above-described compounds, there are compounds shown by the following General formula (7). In the General formula (7), $R^1$ is the same group as in the General formula (1).

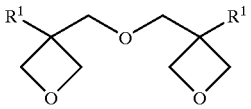

As the compound having 3–4 oxetane rings, the compounds shown in the following General formula (8) are listed.

General formula (8)

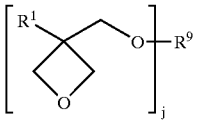

In the formula, $R^1$ is the same group as in the General formula (1). $R^9$ is, for example, branching alkylene group having 1 to 12 carbon atoms such as groups shown by the following General formulas (9), (10), branching poly(alkylene oxy) group such as group shown by the following formula (11), or branching polysiloxane group such as group shown by the following formula (12) is listed. Numeral j is 3 or 4.

General formula (9)

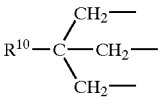

In the formula, $R^{10}$ is a lower alkyl group such as the group having 1 to 5 carbon atoms including methyl group, ethyl group, or propyl group.

General formula (10)

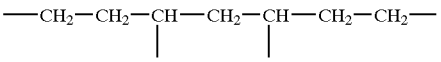

-continued

General formula (11)

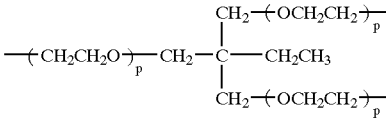

In the General formula (11), numeral p is an integer of 1–10.

General formula (12)

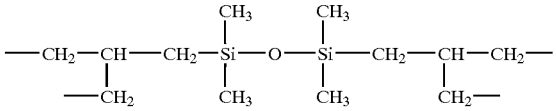

As the specific example of the compound having 3–4 oxetane rings, the compounds shown in the following are listed.

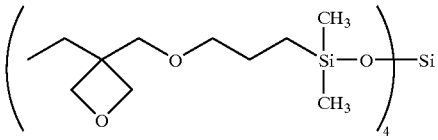

Furthermore, as an example of the compound having 1–4 oxetane rings except the above examples, there is a compound shown in the following General formula (13).

General formula (13)

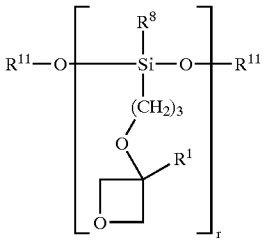

In the formula, $R^8$ is the same group as in the General formula (6). $R^{11}$ is alkyl group having 1 to 4 carbon atoms such as methyl group, ethyl group, propyl group or butyl group, or tri-alkyl silyl group, and numeral r is 1–4.

As a preferable specific example of the oxetane compound used in the present invention, there is a compound shown below.

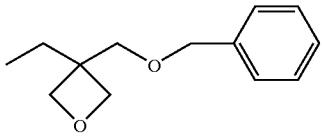

-continued

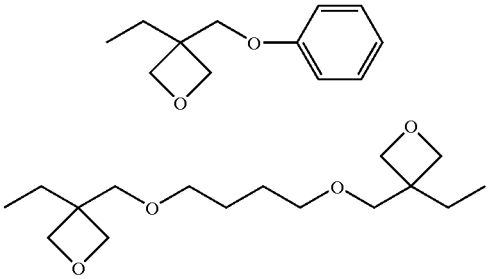

The production method of the compound having the oxetane ring is not particularly limited, and it may be conducted according to the conventionally known method, and for example, there is a synthetic method of an oxetane ring from diol disclosed by Pattison (D. B. Pattison, J. Am. Chem. Soc., 3455, 79 (1957)).

Further, other than them, compounds having 1–4 oxetane rings, which have high molecular weight of molecular weight of about 1000–5000, are also listed. As an example of them, for example, the following compounds are listed.

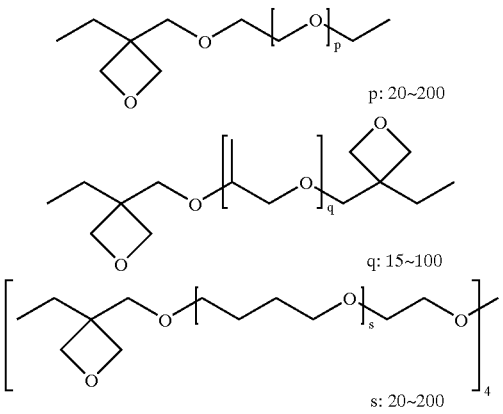

As a preferable compound in the oxetane compounds, there is a compound having oxetane ring and one hydroxyl group in the molecule, and the compound shown by, for example, the following formula can be listed.

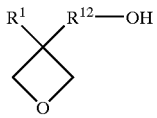

In the formula, $R^1$ is the same group as in the General formula (1). $R^{12}$ is an chained or branched alkylene group having 1 to 6 carbon atoms such as methylene, ethylene, propylene or butylene, and this alkylene group may also be a group having the ether binding, for example, oxy alkylene group such as oxy methylene, oxy ethylene, oxy propylene, or oxy butylene. In these compounds, when the quick hardenability, adhesion, and surface hardness are considered, as $R^1$ and $R^{12}$, the alkyl group having 1 to 6 carbon atoms is preferable, and particularly the alkyl group having 1 to 3 carbon atoms is preferable.

As a specific example of the compound expressed by the above formula, 3-hydroxy methyl-3-methyl oxetane, 3-hydroxy methyl-3-ethyl oxetane, 3-hydroxy methyl-3- propyl oxetane, 3-hydroxy methyl-3-normal butyl oxetane, 3-hydroxy methyl-3-phenyl oxetane, 3-hydroxy methyl-3- benzyl oxetane, 3-hydroxy ethyl-3-methyl oxetane, 3-hydroxy ethyl-3-ethyl oxetane, 3-hydroxy ethyl-3-propyl oxetane, 3-hydroxy ethyl-3-phenyl oxetane, 3-hydroxy propyl-3-methyl oxetane, 3-hydroxy propyl- 3-methyl oxetane, 3-hydroxy propyl-3-ethyl oxetane, 3-hydroxy propyl-3-propyl oxetane, 3-hydroxy propyl-3-phenyl oxetane, and 3-hydroxy butyl-3-methyl oxetane, can be listed. In these compounds, from the easiness of obtaining, as oxetane mono-alcohol compound, 3-hydroxy methyl-3-methyl oxetane and 3-hydroxy methyl-3-ethyl oxetane are preferable.

(Epoxy Compound)

As the epoxy compounds, which are preferably used in the present invention, all publicly known epoxy compounds such as disclosed in JP-A Nos. 2001-55507, 2001-31892, 2001-40068, or 2001-310938, can be used.

As aromatic epoxide, preferable one is di- or poly-glycidyl ether, which is synthesized by the reaction of polyhydric phenol having at least one aromatic core or alkylene oxide-added polyhydric phenol and epichlorohydrin, and for example, di- or poly-glycidyl ether of bisphenol A or of alkylene oxide-added bisphenol A, di- or poly-glycidyl ether of hydrogenated bisphenol A or of alkylene oxide-added hydrogenated bisphenol A, and novolak type epoxy resin, are listed. Herein, as alkylene oxide, ethylene oxide and propylene oxide are listed.

As alicyclic epoxide, a cyclohexen oxide or cyclopentene oxide, which is obtained by epoxidation of the compound having cycloalkane ring such as at least one cyclohexen or cyclopentene ring by the appropriate oxidant such as hydrogen peroxide or peracid, is preferable.

As a preferable aliphatic epoxide, there is di- or poly-glycidyl ether of aliphatic polyvalent alcohol or of alkylene oxide-added aliphatic polyvalent alcohol, and as its representative example, di-glycidyl ether of alkylene glycol such as di-glycidyl ether of ethylene glycol, di-glycidyl ether of propylene glycol and glycidyl ether of 1,6-hexane diol, poly-glycidyl ether of polyvalent alcohol such as di- or tri-glycidyl ether of glyceline or of alkylene oxide added glyceline, and di-glycidyl ether of polyalkylene glycol such as di-glycidyl ether of polyethylene glycol or of alkylene oxide-added polyethylene glycol, and di-glycidyl ether of polypropylene glycol or of alkylene oxide-added polypropylene glycol, are listed. Herein, as alkylene oxide, ethylene oxide and propylene oxide are listed.

In these epoxides, when the quick hardening ability is considered, aromatic epoxide and alicyclic epoxide are preferable, and particularly, alicyclic epoxide is preferable. In the present invention, on kind of the above epoxides may be solely used, and more than 2 kinds of them may also be used by appropriately being combined.

(Vinyl Ether Compound)

Also as a vinyl ether compound preferably used in the ink of the present invention, publicly known vinyl ether compounds can be used, and for example, di or tri-vinyl ether compound, such as ethylene glycol di-vinyl ether, di-ethylene glycol di-vinyl ether, tri-ethylene glycol di-vinyl ether, propylene glycol di-vinyl ether, di-propylene glycol di-vinyl ether, butane diol di-vinyl ether, hexane diol di-vinyl ether, cyclohexane di-methanol di-vinyl ether, tri-methylol propane tri-vinyl ether, or mono vinyl ether compound, such as ethyl vinyl ether, n-butyl vinyl ether, iso-butyl vinyl ether, octadecyl vinyl ether, cyclohexyl vinyl ether, hydroxy butyl vinyl ether, 2-ethyl-hexyl vinyl ether, cyclo-hexane di-methanol mono-vinyl ether, n-propyl vinyl ether, iso-propyl vinyl ether, iso-propenyl ether-o-propylene carbonate, dodecyl vinyl ether, or di-ethylene glycol mono vinyl ether vinyl ether, is listed.

In these vinyl ether compounds, when the hardenability, adhesion or surface hardness is considered, di or tri-vinyl ether compound is preferable, and particularly di-vinyl ether compound is preferable. In the present invention, one kind of the above vinyl ether compounds may also be used, and more than two kinds of them may be used by being appropriately combined.

As the photo initiator, all publicly known photo acid generators (a compound which generates the acid by the active ray) can be used. As the photo acid generator, for example, a chemical amplification type photo resist or compound used for the light cationic polymerization is used (Organic electronics material seminar "organic material for imaging" from Bunshin publishing house (1993), refer to page 187–192). Examples preferable for the present invention will be listed below. Firstly, aromatic onium compound $B(C_6F_5)_4^-$, $PF_6^-$, $AsF_6^-$, $SbF_6^-$, $CF_3SO_3^-$ salt, such as diazonium, ammonium, iodonium, sulfonium, phosphonium, can be listed. Specific examples of the onium compounds will be shown below.

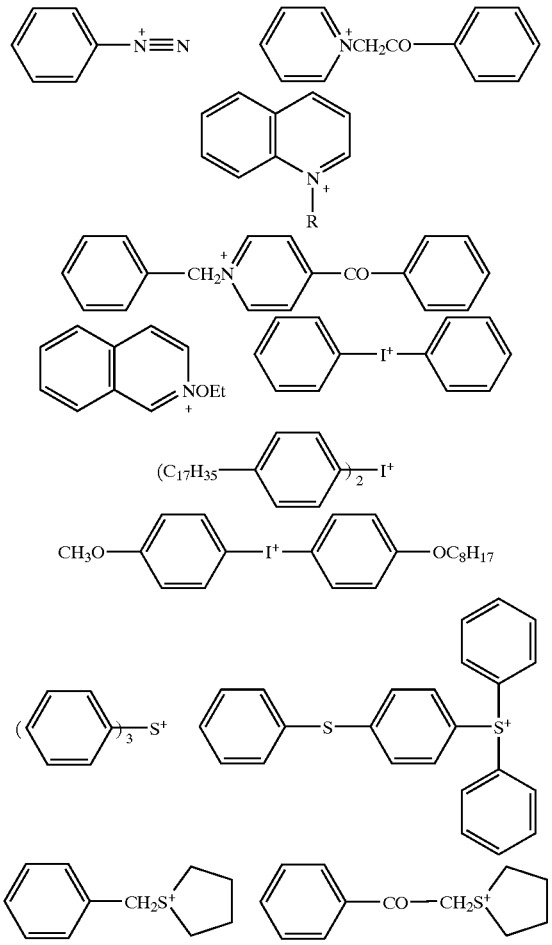

-continued

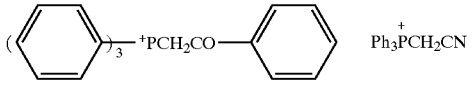

Secondly, sulfone compounds, which generate sulfonic acid, can be listed. Examples of specific compounds will be shown below.

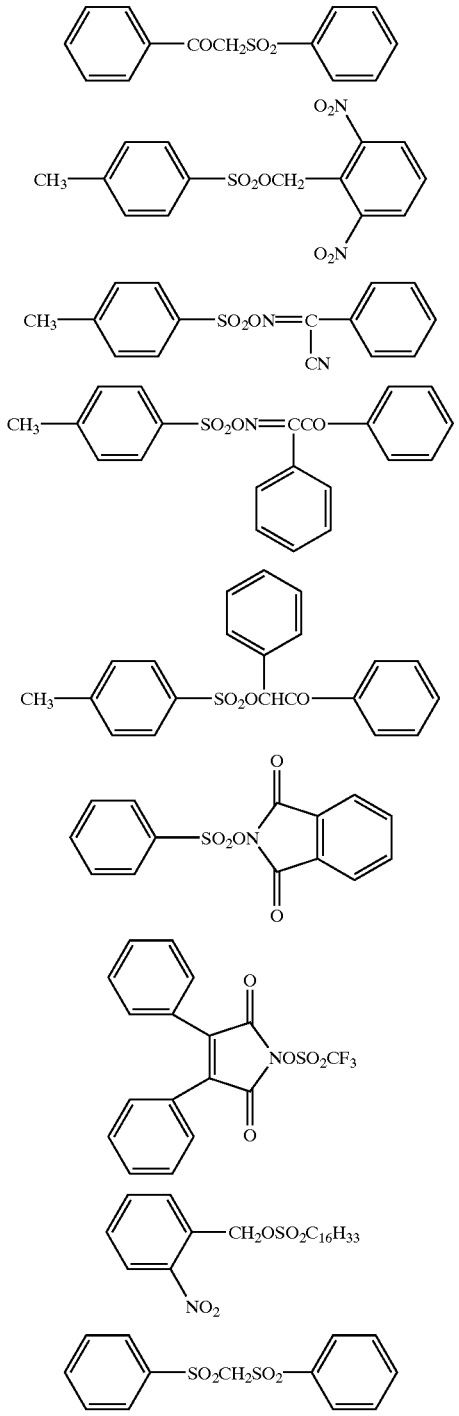

-continued

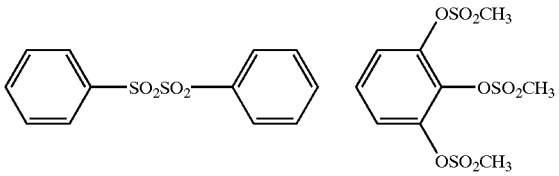

Thirdly, halogenide which generates hydrogen halide can also be used. Examples of specific compounds will be shown below.

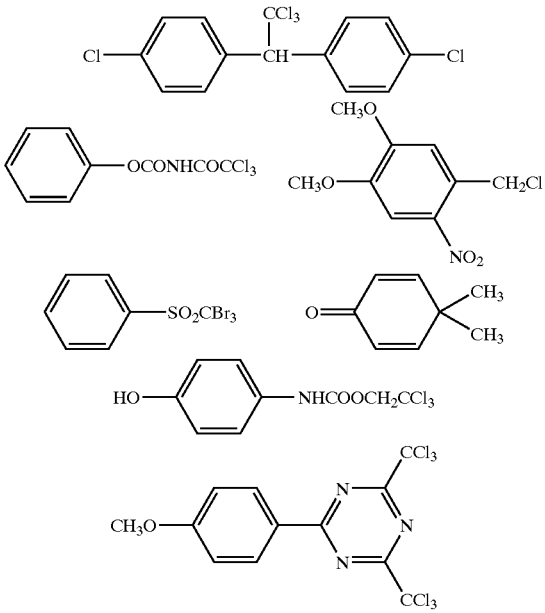

Fourthly, ferrite allen complex can be listed.

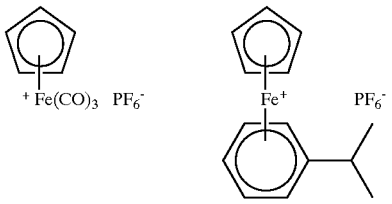

As the ink of the present invention, it is preferable that an acid breeding agent, which newly generates the acid by the acid generated by the irradiation of the active ray which is already publicly known, commencing with JP-A Nos. H8-248561, and H9-034106, is included. By using the acid breeding agent, the more increase of jetting stability, decrease of curl and wrinkle of the recording material are made possible.

Other than above, when the ink component materials are colored, colorants can be added. As the colorants, the colorants, which can be solved or dispersed in main component of the polymeric compound, can be used, however, from the point of weather fastness, the pigment is preferable. As the pigment, the following can be used, however, it is not limited to this.

C.I. Pigment Yellow-1, 3, 12, 13, 14, 17, 81, 83, 87, 95, 109, 42,

C. I. Pigment Orange-16, 36, 38,

C. I. Pigment Red-5, 22, 38, 48:1, 48:2, 48:4, 49:1, 53:1, 57:1, 63:1, 144, 146, 185, 101, C. I. Pigment Violet-19, 23, C. I. Pigment Blue-15:1, 15:3, 15:4, 18, 60, 27, 29, C. I. Pigment Green-7, 36

C. I. Pigment White-6, 18, 21,

C. I. Pigment Black-7.

Further, in the present invention, in order to increase the screening property of the color in the transparent recording material such as the plastic film, it is preferable that the white ink is used. Particularly, in the soft packing print, and label print, the white ink is essential, but because the jetting amount is large, the problem of the above-described jetting stability and curl and wrinkle of the recording material becomes conspicuous.

For the dispersion of the pigment, a ball mill, sand mill, attritor, roll mill, agitator, Henschel mixer, colloid mill, ultrasonic homogenizer, Pearl mill, wet jet mill, or paint shaker may be used. Further, when the pigment is dispersed, the dispersing agent can also be added. It is preferable that, as the dispersing agent, high polymeric dispersing agent is used. As the high polymeric dispersing agent, Solsperse series of Avecia co., is listed. Further, as the dispersion auxiliary agent, the synergist corresponding to each kind of pigment can also be used. It is preferable that 1–50 parts by weight of these dispersing agent and dispersion auxiliary agent are added to 100 parts by weight of the pigment. The dispersion medium is solvent or polymeric compound, and it is preferable that the irradiated radiation hardening type ink used in the present invention is no-solvent, because it is reacted and hardened just after the arrival of the ink. When the solvent remains in the hardened image, the problem of deterioration of solvent resistance and VOC (Volatile Organic Compound) of the remained solvent is generated. Accordingly, it is preferable in the dispersion aptitude that the dispersion medium is not solvent, but polymeric compounds, and the monomer in which the viscosity is lowest in them, is selected.

When the dispersion is conducted, it is preferable to configure the pigment, dispersing agent, selection of diluent for the dispersion so that average particle size of the pigment become 0.08–0.5 $\mu$m, more preferably 0.3–10 $\mu$m, still more preferably, 0.3–3 $\mu$m. By this particle size control, the nozzle plugging of the inkjet head is suppressed, and the preservation stability of the ink, ink transparency and hardening sensitivity can be maintained.

It is preferable for the colorant that the addition amount is 1 weight % to 10 weight % of the whole of the ink.

(The Other Components)

In order to increase the keeping quality of the ink components, the polymerization inhibitor of 200–20000 ppm can be added. Because it is preferable that the ultraviolet ray hardenable type ink is heated and made to low viscosity, and jetted, it is preferable for preventing the head from plugging by the thermal polymerization that the polymerization inhibitor is added. As the polymerization inhibitor, for example, a basic compound can be added.

Other than that, corresponding to the necessity, the surfactant, leveling additive agent, mat agent, polyester resin for adjusting the film property, polyurethane resin, vinyl resin, acrylic resin, rubber resin, or wax can be added. In order to improve the adhesion to the recording medium, it is also effective that the very fine amount of organic solvent is added. In this case, the addition within the range that the problem of the solvent resistance or VOC is not generated, is effective, and the amount is 0.1–5 weight %, preferably 0.1–3 weight % of total ink weight.

Further, it is also possible that the radical polymeric monomer and the initiator are combined, and the hybrid type hardening ink of the radical and cation is made.

EXAMPLES

The present invention will be more specifically described by Examples below, however, the present invention is not limited to them.

Inkjet head and inkjet printer engine

FIG. 1 is a structural sectional view of an inkjet head, which is an example of the inkjet printer for which the ink hardenable by an irradiation of the active ray used in the present invention is used.

In the ink supply system, the ink is supplied from an ink supply pipe 5 to the piezoelectric type inkjet head 19 through an unillustrated initial tank, supply piping and filter.

In the FIG. 1, numeral 1 is a substrate, numeral 2 is a piezoelectric element, numeral 3 is a passage plate, numeral 3*a* is an ink passage, numeral 4 is an ink supply tank, numeral 4*a* is an ink chamber, numeral 5 is an ink supply pipe, numeral 6 is a nozzle plate, numeral 6*a* is a nozzle, numeral 7 is a drive circuit printed board, numeral 8 is a lead wire, numeral 9 is a drive electrode, numeral 11 is a protection plate, numeral 16 is a heater, numeral 17 is a heater power source, and numeral 18 is a heat transfer member, and an inkjet head 19 having them is shown.

For the inkjet head portion, heat was insulated and added by the heater 16. The temperature sensors were respectively provided near the ink supply tank and nozzle of the inkjet head, and the temperature control was conducted so that the nozzle portion was always the setting temperature±2° C. The pitch of nozzle was 300 dpi (dpi expresses the number of dots per 2.54 cm), and 512 nozzles were provided per one head. In order to obtain the liquid drop amounts and film thickness written in the Table, the nozzle diameter was adjusted to 10–30 $\mu$m, the jetting temperature was adjusted to 20–150° C., and the drive voltage was adjusted within the range of 5–30 V, and the ink was jetted. The recording density was 600 dpi.

FIG. 2 shows an outline structural view of the inkjet printer which has the inkjet head and in which the irradiation light source of the active ray is arranged. The printer A has an arrangement of the irradiation light source in which the active light source is irradiated just after the printing is conducted by one inkjet head, and the printer B has an arrangement in which the inkjet head and the light source are alternately arranged, and the printing is conducted in multi-stages and the irradiation is conducted in multi-stages, and the printer C has an arrangement in which the active ray is irridated at the last time, after the printing is conducted by the inkjet head in the multi-stages.

(Preparing the Ink for Inkjet)

The Production of the Ink Set A

The ink set A of yellow (Y), magenta (M), cyan (C), and black (K) was produced by the composition shown in Table 1 (part by weight of each ink is shown).

TABLE 1

| | | Ink set A | | | | |
|---|---|---|---|---|---|---|
| Material | | K | C | M | Y | |
| Colorant | | CI pigment Black 7 | CI pigment Blue 15:3 | CI pigment Red 57:1 | CI pigment Yellow 13 | |
| Amount of colorant | | 5.0 | 2.5 | 3. 0 | 2.5 | Note |
| *1 | **1 | 51.0 | 58.5 | 58.0 | 58.5 | oxetane compound |
| *2 | **2 | 20.0 | 20.0 | 20.0 | 20.0 | epoxy compound |
| *3 | **3 | 15.0 | 10.0 | 10.0 | 10.0 | vinyl ether compound |
| *4 | **4 | 3.0 | 3.0 | 3.0 | 3.0 | |
| Initiator | MP1103 (Midori Chem.) | 5.0 | 5.0 | 5.0 | 5.0 | cation polymerization |
| *5 | Diethyl oxisanton | 1.0 | 1.0 | 1.0 | 1.0 | |

*1: photo polymeric compound: **1 OXT-222 (Towa Gosei)
*2: photo polymeric compound: **2 CELOXIDE 2021P (Daisel Chem. Industry)
*3: photo polymeric compound: **3 GT403 (Daisel Chem. Industry)
*4: Acid breeding agent: **4 ACPRESS 11M (Nippon Chemics)
*5: Initiator auxiliary agent The ink set B of yellow (Y), magenta (M), cyan (C), and black (K) was produced by the composition shown in Table 2 (part by weight of each ink is shown).

TABLE 2

| | | Ink set B | | | | |
|---|---|---|---|---|---|---|
| Material | | K | C | M | Y | |
| Colorant | | CI pigment Black 7 | CI pigment Blue 15:3 | CI pigment Red 57:1 | CI pigment Yellow 13 | |
| Amount of colorant | | 3.0 | 3.0 | 3.0 | 2.0 | Note |
| *1 | **1 | 1.0 | 1.0 | 1.0 | 1.0 | |
| *2 | **2 | 76.0 | 76.0 | 76.0 | 77.0 | acrylic compound |
| *3 | **3 | 10.0 | 10.0 | 10.0 | 10.0 | acrylic compound |
| *4 | **4 | 5.0 | 5.0 | 6.0 | 5.0 | acrylic compound |
| Initiator | **5 | 5.0 | 5.0 | 5.0 | 5.0 | radical polymerization |

*1: high molecular dispersing agent, **1 Solsperse (Zeneka Co.)
*2: photo polymerizing compound, **2 stearyl acrylate
*3: photo polymerizing compound, **3 tetra ethylene glycol di-acrylate (2 functions)
*4: photo polymerizing compound, **4 caprolactam denaturation di-penta-erythritol hexa-acrylate (6 functions)
**5: Irgacure 184 (Ciba Co.)

Example 1

As the printer, the printer A shown in FIG. 2 was used, and as the ink, K of the ink sets A and B was used. Hereupon, as the irradiation light source, the light source shown in the following was used.

(Irradiation Light Source)

Ultraviolet fluorescent lamp: made by Nippo Elec. Co., main wavelength 365 nm.

Metal halide: made by Nippon battery Co., main wavelength 365 nm.

Other than that, the level of banding and bleeding when the printing was conducted under the condition written in Table 3 was evaluated.

(Banding)

Under the condition written in Table 3, a solid patch is printed, and its level was confirmed.

A: no banding was seen
B: slight banding was seen
C: strong banding was seen

A and B was a practical use level.

(Bleeding)

The above apparatus is used, and in the solid patch, the sampling characters whose size is different are produced, and the number of the points of the character at which there is no bleeding and which is fairly reproducible, is recorded.

The reviewed result is shown in Table 3.

TABLE 3

| Printer | Light source | input power (W/cm) | Irradiation timing (sec) | Ink set | Banding | Bleeding | Note |
|---|---|---|---|---|---|---|---|
| A | *1 | 1.2 | 0.1 | A | A | 6 | Inv. |
| A | *2 | 1.2 | 1.2 | A | A | 6 | Inv. |
| A | *3 | 4 | 0.1 | B | B | 10 | Com. |
| A | Metal halide | 80 | 3 | B | C | 20 | Com. |

*1: UV fluorescent lamp (365 nm), 3 pieces.
*2: UV fluorescent lamp (365 nm), 3 pieces.
*3: UV fluorescent lamp (365 nm), 10 pieces.
Inv.: the present invention
Com.: comparison

Example 2

Under the condition of Table 4 (the printers B and C, all colors of the ink sets A and B were used), the gradation properties when the gradations of the primary colors (Y, M, C, K), and the secondary colors (B, G, R) were printed, were evaluated.

A: there was no tone jump
B: there was a slight tone jump
C: tone jump was conspicuous, and it could not be practically used.

The reviewed result is shown in Table 4.

TABLE 4

| Printer | Light source | Input power (W/cm) | irradiation timing (sec) | Ink set | Gradation | Note |
|---|---|---|---|---|---|---|
| B | *1 | 1.2 | 0.1 | A | A | Inv. |
| C | Metal halide | 80 | 1.2–2.5 | B | C | Com. |

*1: UV fluorescent lamp (365 nm), 3 PCs./one color,
Inv.: present invention,
Com.: comparative

Effects

As is apparent from the foregoing, a inkjet image forming method which provides high quality and excellent in banding, bleeding and gradation property image, can be provided.

What is claimed is:

1. An inkjet image forming method comprising:

jetting an ink hardenable by irradiation with an active ray from an inkjet head onto a recording material while conveying the recording material, the temperature of the ink being controlled so that the viscosity of the ink is 5–25 mPa·s; and irradiating the active ray on the jetted recording material, wherein a total of an input electric power of a light source of the active ray of light is 0.05–20 W/cm, the ink contains a solvent in an amount of 0.1 to 5 weight % based on the total weight of the ink, and the inkjet head has plural nozzles arrayed in a direction perpendicular to the direction at which the recording material is conveyed, and wherein the ink includes at least one compound selected from the oxetane compound, epoxy compound and vinyl ether compound, and a compound which generates the acid by the active ray of light.

2. The inkjet image forming method of claim 1, wherein the oxetane compound is a compound having 1 to 4 oxetane rings.

3. The inkjet image forming method of claim 1, wherein the oxetane compound is represented by any one of General formulas (1), (2), (7), (8), (13) and (14)

General formula (1)

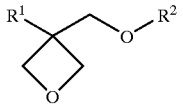

wherein, $R^1$ is a hydrogen atom, alkyl group having 1 to 6 carbons, fluoro-alkyl group having 1 to 6 carbon atoms, allyl group, aryl group, furyl group, or thienyl group; $R^2$ is an alkyl group having 1 to 6 carbons, alkenyl group having 2 to 6 carbons, a group having the aromatic ring, or ethyl carbonyl group, alkyl carbonyl group having 2 to 6 carbon atoms, alkoxy carbonyl group having 2 to 6 carbons, N-alkyl carbamoyl group having 2 to 6 carbon atoms;

General formula (2)

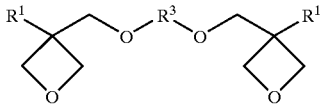

wherein, $R^1$ is the same group as the group shown in the General formula (1); $R^3$ is a linear or branching alkylene group, linear or branching poly (alkylene-oxy) group, linear or branching un-saturated hydrocarbon group, or carbonyl group, alkylene group including carbonyl group, or alkylene group including carboxyl group, or alkylene group including carbamoyl group; $R^3$ may also be a poly-hydric group selected from the group shown by the following General formulas (3), (4) and (5);

General formula (3)

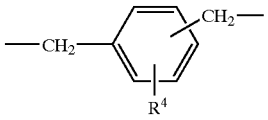

wherein, $R^4$ is a hydrogen atom, an alkyl group having 1 to 4 carbon atoms, alkoxy group having 1 to 4 carbon atoms, halogen atom, nitro group, cyano group, mercapto group, lower alkyl carboxyl group, carboxyl group, or carbamoyl group;

General formula (4)

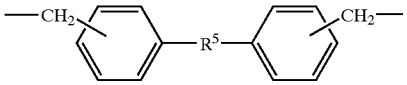

wherein, $R^5$ is an oxygen atom, sulfide atom, methylene group, NH, SO, $SO_2$, $C(CF_3)_2$, or $C(CH_3)_2$ General formula (5)

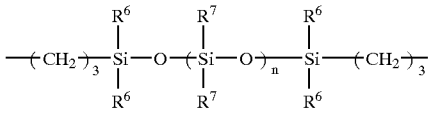

wherein, $R^6$ is an alkyl group having 1 to 4 carbon atoms or aryl group; Numeral n is an integer of 0–2000; $R^7$ is an alkyl group having 1 to 4 carbon atoms or an aryl group; $R^7$ is also a group shown by the following General formula (6);

General formula (6)

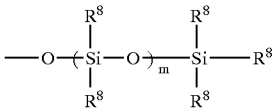

wherein, $R^8$ is an alkyl group having 1 to 4 carbon atoms or an aryl group; Numeral m is an integer of 0–100;

General formula (7)

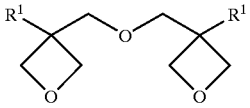

wherein, $R^1$ is the same group as described in the General formula (1);

General formula (8)

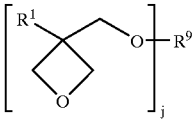

wherein, $R^1$ is the same group as in the General formula (1); $R^9$ is a branched alkylene group having 1 to 12 carbon atoms, a branched poly(alkylenoxy) group or a branched polysiloxane group; Numeral j is 3 or 4;

General formula (13)

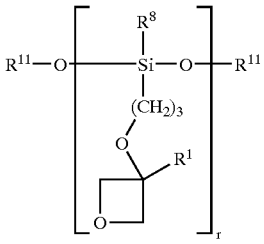

wherein, $R^8$ is the same group as in the General formula (6); $R^{11}$ is alkyl group having 1 to 4 carbon atoms or tri-alkyl silyl group, and numeral r is 1–4;

General formula (14)

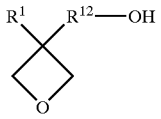

wherein, $R^1$ is the same group as in the General formula (1); $R^{12}$ is a linear or branched alkylene group having 1 to 6 carbon atoms, and this alkylene group may also be a group having the ether binding, oxy alkylene group.

4. The inkjet image forming method of claim 1, wherein the oxetane compound is represented by any one of following formulas:

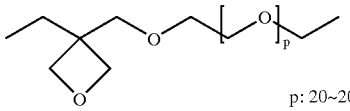

p: 20~200

-continued

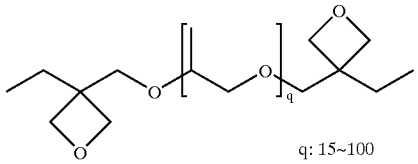

q: 15~100

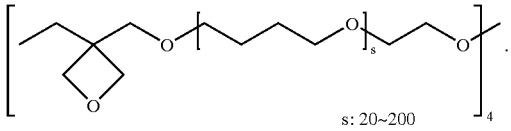

s: 20~200

5. The inkjet image forming method of claim 1, wherein the epoxy compound comprises an aromatic epoxide or aliphatic ring epoxide.

6. The inkjet image forming method of claim 1, wherein the vinyl ether compound comprises a di or tri vinyl ether compound.

* * * * *